US005482091A

United States Patent [19]

Debaes

[11] Patent Number: 5,482,091

[45] Date of Patent: Jan. 9, 1996

[54] FABRIC

[75] Inventor: Johnny Debaes, Wenduine, Belgium

[73] Assignee: N.V. Michel van de Wiele, Marke, Belgium

[21] Appl. No.: 385,803

[22] Filed: Feb. 9, 1995

[30] Foreign Application Priority Data

Feb. 10, 1994 [BE] Belgium ..... 09400159

[51] Int. Cl.[6] ..... D03D 27/00

[52] U.S. Cl. ..... 139/391; 139/392; 428/93; 428/95; 428/225; 428/227; 428/229; 428/257

[58] Field of Search ..... 428/93, 95, 225, 428/227, 229, 257; 139/391, 392

[56] References Cited

U.S. PATENT DOCUMENTS

| | | | |
|---|---|---|---|
| 4,407,885 | 10/1983 | Murphy et al. | 428/257 |
| 5,080,141 | 1/1992 | Bottger et al. | 428/225 |
| 5,137,058 | 8/1992 | Anahara et al. | 428/225 |
| 5,164,250 | 11/1992 | Rodriguez | 428/225 |

FOREIGN PATENT DOCUMENTS

| | | | |
|---|---|---|---|
| 0891638 | 4/1982 | Belgium | D03D 27/10 |
| 0119184 | 9/1984 | European Pat. Off. | D03D 27/10 |
| 0565122 | 10/1993 | European Pat. Off. | D03D 27/10 |
| 0624660 | 10/1931 | France | D03D 27/10 |
| 0610168 | 6/1934 | Germany . | |

*Primary Examiner*—James J. Bell

*Attorney, Agent, or Firm*—Brumbaugh, Graves, Donohue & Raymond

[57] ABSTRACT

A fabric comprising binding warp threads, tension warp threads, weft threads and pile threads or a part thereof, in which binding warp threads cross each other in pairs in order to form a series of openings, and in which at least two weft threads pass through at least some of the openings. The fabric has at least two tension warp threads per pair of binding warp threads. Each pair of binding warp threads extend between two adjacent tension warp threads.

8 Claims, 2 Drawing Sheets

FABRIC

BACKGROUND OF THE INVENTION

The invention relates to a fabric comprising binding warp threads, tension warp threads, weft threads and pile threads or a part thereof, in which binding warp threads cross each other in pairs in order to form a series of openings, and in which at least two weft threads pass through at least some of the openings.

DE PS 610,168 discloses a two-shot weave for pile fabric in which, in successive cycles, two weft threads are inserted simultaneously in the top fabric and then two weft threads are inserted simultaneously in the bottom fabric. The weave consists of a tension warp and two binding warps for the backing fabric, with the bound-in dead pile warp and the bound-off active pile for the bottom and the top fabric, respectively. In order to weave this pile fabric, pile threads are passed through in a weaving reed dent depending on the number of thread or color systems, two tension warp threads (one for the bottom fabric OW and one for the top fabric BW) and four binding warp threads (two for the bottom fabric OW and two for the top fabric BW).

The fabric obtained after cutting into the bottom fabric and the top fabric has a pile appearance like that shown in FIG. 1. Next to a first tension warp thread are two binding warp threads. Then follows the bound-off pile tuft and the bound-in pile warp. The same sequence is then found for tension warps, binding warp etc. In the case of a first pile tuft we see that the base of the U-shaped pile tuft is pushed to the right by the left binding warp thread nearest to it in the bottom position on the back of the fabric, while the upright legs of the U-shaped pile tuft are pushed by the bound-in pile warp threads against the top binding warp thread lying more to the left on the pile side. This means that the pile tuft legs are oriented to the left. On the next pile tuft in the warp direction this phenomenon is reversed, with the result that the pile tuft legs are oriented to the right. Summarizing, it can be said that the second binding warp thread first pushes the tuft on the back to the right and on the next tuft in the warp direction pushes the legs on the pile side to the right. This means that the pile tuft legs no longer ultimately lie with their ends in a neat row. The color lines in the carpet have a zigzag effect. This zigzag effect is all the more pronounced if the reed setting, and thus the warp setting, is relatively low: for example less than 350/m and where thicker yarns are being used for carpet with lower pile warp counts.

SUMMARY OF THE INVENTION

In order to overcome this disadvantage, according to the invention, a second tension warp per piece is inserted in the fabric.

The fabric according to the invention comprises binding warp threads, tension warp threads, weft threads and pile threads or part thereof. The binding warp threads are arranged in pairs with each pair of binding warp threads being crossed to each other to form a series of openings. At least two weft threads pass through selected ones of the openings. The fabric also has a plurality of tension warp threads, whereby each pair of binding warp threads are disposed between at least two of the tension warp threads. Further, the number of the tension warp threads relative to the number of pairs of the binding warp threads is maintained at a ratio of at least two to one.

According to one embodiment of the invention, at least two tension warp threads extend between two adjacent pairs of binding warp threads or reed dent.

According to a special feature of said embodiment, which is preferred, the following extend between two adjacent pairs of binding warp threads or per reed dent:

* a first tension warp thread lying next to a first pair of binding warp threads;

* a second tension warp thread lying next to the second pair of binding-warp threads;

* pile threads or part thereof which are bound off or bound in between the first and the second tension warp threads.

The following preferably extend between two adjacent pairs of binding warp threads or per reed dent:

* a first tension warp thread touching a first pair of binding warp threads;

* a second tension warp thread touching the second pair of binding warp threads; and

* pile threads or part thereof which are bound off or bound in between the first and the second tension warp threads.

The invention also relates to a structure consisting of a top fabric and a bottom fabric which are interconnected by pile threads, and in which the top fabric and/or the bottom fabric is a fabric according to the invention.

BRIEF DESCRIPTION OF THE DRAWING

Other features and details of the invention will emerge from the description which follows with reference to the appended drawing.

In the drawing.

DETAILED DESCRIPTION OF THE INVENTION

Figure 1:
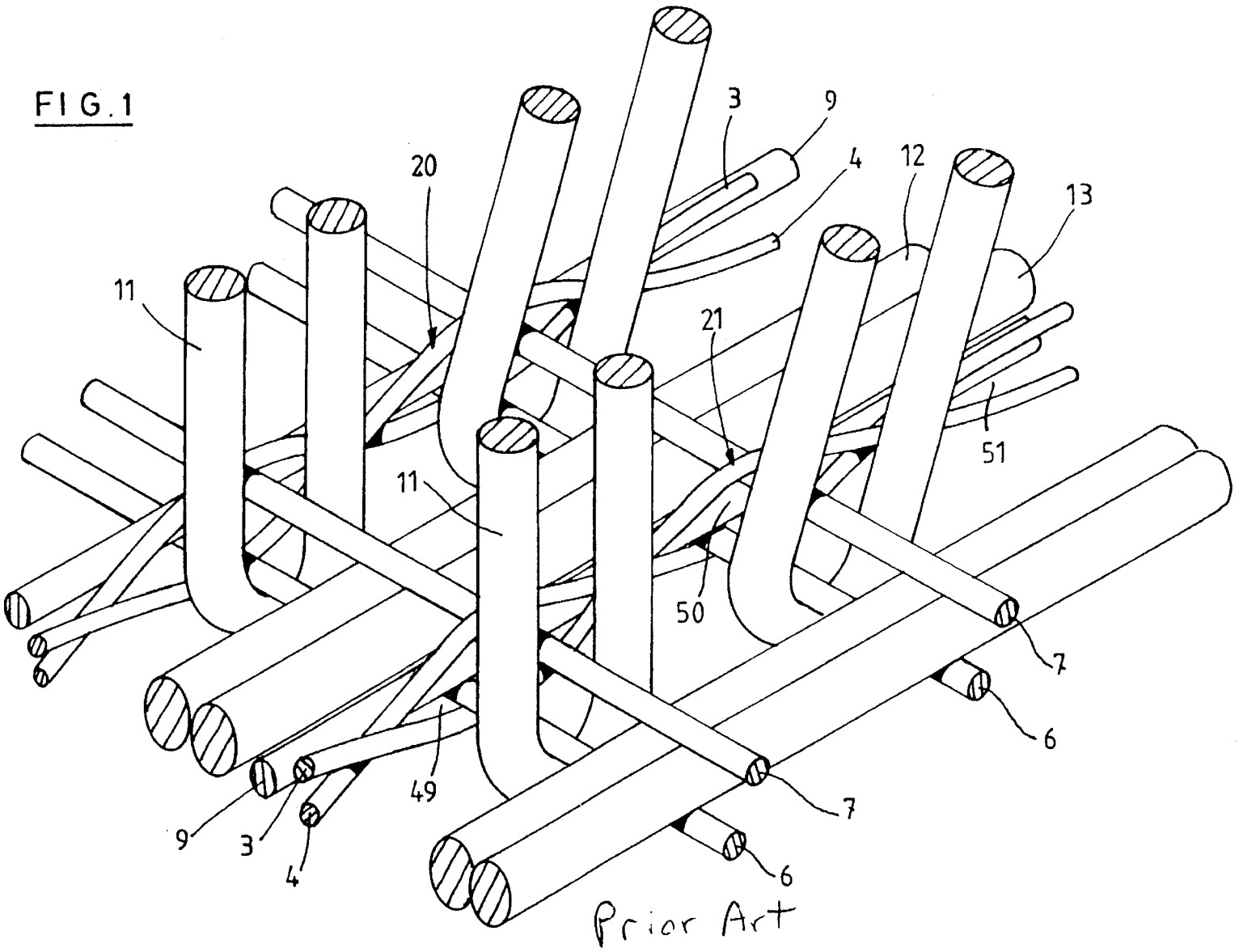
FIG. 1 shows a perspective view of a portion of a prior art fabric.

FIG. 1 shows a part of a fabric according to DE PS 610,168 or BE 09200324. The fabric is obtained by cutting a structure which is produced by means of a two-shot weave for pile fabrics. In successive cycles two weft threads 6, 7 are inserted simultaneously in the top fabric and then two weft threads 6, 7 are inserted simultaneously in the bottom fabric.

The weave consists of a tension thread 9 and two binding warp threads 3, 4.

In this fabric, binding warp threads cross each other in pairs in order to form openings 49, 50, 51 through which two weft threads 6, 7 pass. Only one tension warp thread 9 per pair of binding warp threads 3, 4 which cross each other is present in this fabric. Thus, the ratio of the tension warp thread 9 relative to the number of pairs of the binding warp threads 3, 4 is at a ratio of one to one.

The following extend per reed dent or between two adjacent pairs 20, 21 of binding warp threads 3, 4:

- a part 11 of a pile thread;

- two bound-in pile threads 12, 13; and

- a tension warp thread 9 which touches binding warp threads of a pair.

Figure 2:
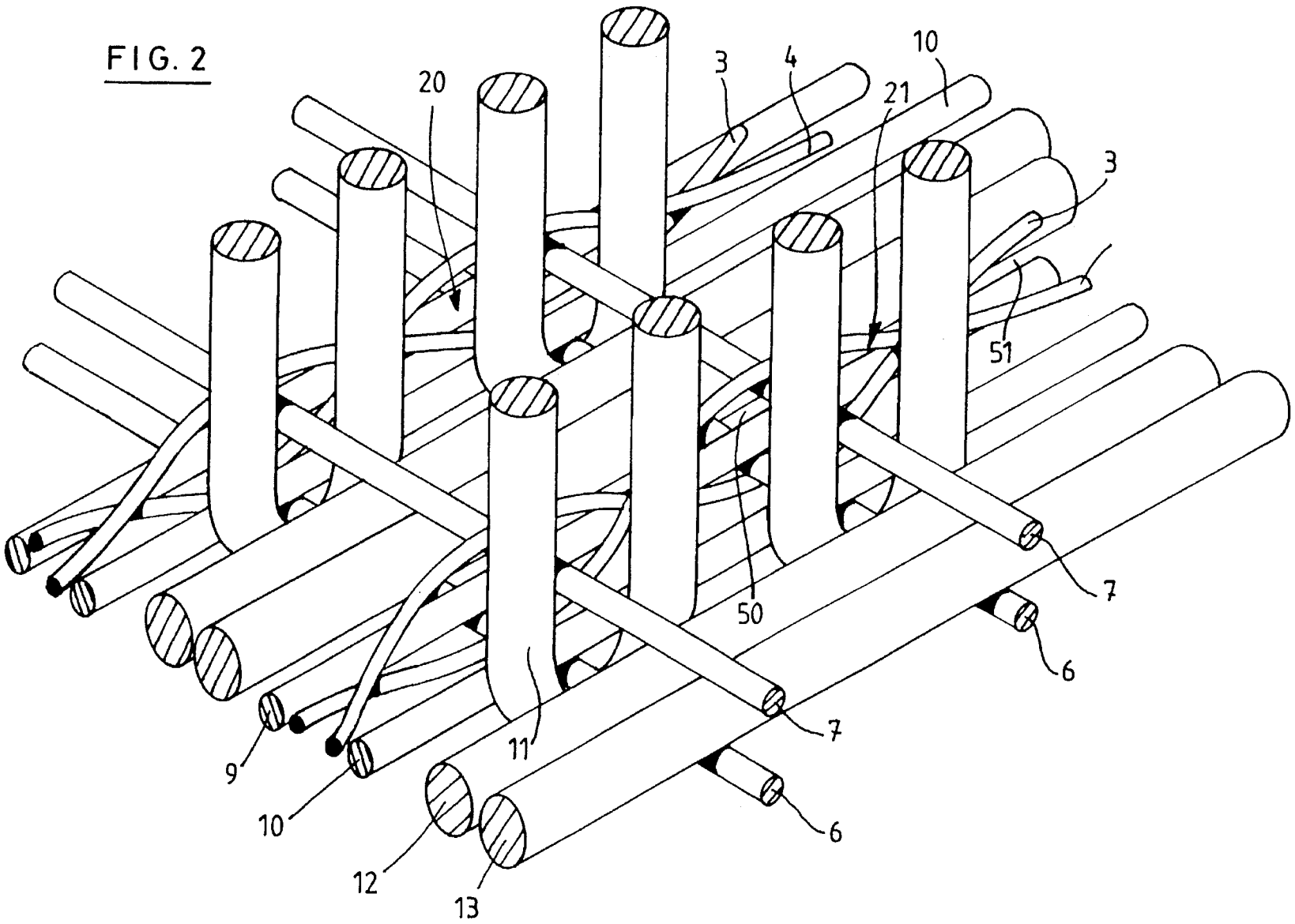
FIG. 2 shows a perspective view of a portion of a fabric according to the invention.

FIG. 2 shows a fabric according to the present invention comprising:

* binding warp threads 3, 4 which cross each other in pairs;

* tension warp threads 9, 10;

* weft threads 6, 7 which pass through in the openings 49, 50, 51 formed by the binding warp threads 3, 4 crossing each other; and

* pile warp threads 11, 12, 13 or parts thereof (pile warp thread 11 is bound off, while pile warp threads 12, 13 are bound in).

The fabric has two tension warp threads 9, 10 per pair of binding warp threads 3, 4 which cross each other. Thus, the ration of the tension warp threads 9, 10 relative to the number of pairs of the binding warp threads 3, 4 is maintained at a ratio of at least two to one.

The warp threads are passed through in the following order in each reed opening: all pile threads 11, 12, 13..., of which only those which form pile or are bound into the bottom fabric are shown, tension warp threads 9, the pair of binding warp threads 3, 4 and then tension warp thread 10, while the pair of binding warp threads 3, 4 always cross between tension warp threads 9 and 10.

As it can be seen from FIG. 2, each pair of binding warp threads 3, 4 extend between two adjacent tension warp threads 9, 10 and contact said tension warp threads 9, 10.

In the case shown, one or several pile warp threads 11, 12, 13 or parts thereof extend between two adjacent tension warp threads 9, 10, the latter contacting pile warp threads.

The cross-sections (perpendicular to the longitudinal direction of adjacent tension warp threads) of tension warp threads 9, 10 are separated the one from the other in the longitudinal direction of weft threads or in a direction parallel to a plane containing for example the bottom weft threads 6.

I claim:

1. A fabric comprising:

a plurality of binding warp threads arranged in pairs, each pair of binding warp threads being crossed to each other to form a plurality of openings;

at least two weft threads passing through selected ones of said openings; and a plurality of tension warp threads, each pair of binding warp threads being disposed between at least two of said tension warp threads, the number of said tension warp threads relative to the number of pairs of said binding warp threads being maintained at a ratio of at least two to one.

2. The fabric of claim 1 further comprising a plurality of pile threads, one or more of said pile threads extending between two adjacent tension warp threads.

3. The fabric of claim 2, wherein the tension warp threads are substantially perpendicular to the weft threads, the tension warp threads being separated from each other along a longitudinal axis of the weft threads.

4. The fabric of claim 3 further comprising the following combination of threads:

a first pair of binding warp threads;

a first tension warp thread lying next to the first pair of binding warp threads;

a second tension warp thread lying next to a second pair of binding warp threads; and a plurality of pile threads bound between the first and second tension warp threads.

5. The fabric of claim 4, further comprising the following combination of threads:

the plurality of pile threads;

the second tension warp thread lying next to the plurality of pile threads; and a second pair of binding warp threads lying next to the second tension warp thread.

6. A fabric comprising:

a first tension warp thread in contact with a first pair of binding warp threads;

a second tension warp thread in contact with a second pair of binding warp threads; and a plurality of pile threads disposed between the first and second tension warp threads, each of said first and second tension warp threads being in contact with a different one of said pile threads.

7. A structure comprising two or more fabrics being interconnected by pile threads, wherein at least one of the two or more fabrics is the fabric claimed in claim 5.

8. A structure comprising two or more fabrics being interconnected by pile threads, wherein at least one of the two or more fabrics is the fabric claimed in claim 6.

* * * * *